US005367118A

United States Patent [19]

Iwaooji

[11] Patent Number: 5,367,118

[45] Date of Patent: Nov. 22, 1994

[54] DIGITAL PITCH SHIFTER FOR READING OUT PITCH-SHIFTED WAVEFORM DATA FROM A MEMORY

[75] Inventor: Makoto Iwaooji, Hamura, Japan

[73] Assignee: Casio Computer Co., Ltd., Tokyo, Japan

[21] Appl. No.: 839,184

[22] Filed: Feb. 21, 1992

[30] Foreign Application Priority Data

Mar. 19, 1991 [JP] Japan ..... 3-054274

[51] Int. Cl.[5] ..... G10H 1/057; G10H 7/02

[52] U.S. Cl. ..... 84/604; 84/607; 84/626; 84/627; 381/61

[58] Field of Search ..... 84/602–607, 84/626, 627; 381/31, 32, 61–65

[56] References Cited

U.S. PATENT DOCUMENTS

| | | | |
|---|---|---|---|
| 3,934,094 | 1/1976 | Kobayashi et al. . | |
| 4,121,058 | 10/1978 | Jusko et al. . | |
| 4,348,929 | 9/1982 | Gallitzendörfer | 84/607 |
| 4,611,522 | 9/1986 | Hideo et al. . | |
| 4,633,749 | 1/1987 | Fujimori et al. | 84/607 |
| 4,864,626 | 9/1989 | Yang . | |
| 4,915,001 | 4/1990 | Dillard . | |
| 5,086,685 | 2/1992 | Hanzawa et al. . | |
| 5,123,322 | 6/1992 | Hanzawa et al. . | |

FOREIGN PATENT DOCUMENTS

| | | |
|---|---|---|
| 0390037A3 | 10/1990 | European Pat. Off. . |
| 60-35795 | 2/1985 | Japan . |
| 60-159799 | 8/1985 | Japan . |
| 63-239495 | 10/1988 | Japan . |
| 63-264797 | 11/1988 | Japan . |
| 64-26899 | 1/1989 | Japan . |

*Primary Examiner*—Stanley J. Witkowski

*Attorney, Agent, or Firm*—Frishauf, Holtz, Goodman & Woodward

[57] ABSTRACT

Waveform data written in a RAM 2 base on write addresses is always read out as two waveform data from two read addresses 1 and 2 designated by a CPU 1, and two interpolation data 1 and 2 are formed. A smaller address difference A between the write address and the read address 1 is multiplied with the interpolation data 1 as an envelope value to obtain cross-fade data 1. Similarly, cross-fade data 2 corresponding to the read address 2 is obtained. The two items of cross-fade data 1 and 2 are added to each other to obtain output waveform data. An envelope value of waveform data near a waveform discontinuous point becomes almost zero, and click noise can be eliminated.

14 Claims, 9 Drawing Sheets

DIGITAL PITCH SHIFTER FOR READING OUT PITCH-SHIFTED WAVEFORM DATA FROM A MEMORY

BACKGROUND OF THE INVENTION

1. Field of the Invention

The present invention relates to a digital pitch shifter for shifting the pitch of an input signal according to a digital signal processing technique and, more particularly, to a digital pitch shifter which can prevent generation of a discontinuous point of a signal waveform.

2. Description of the Related Art

Conventionally, a strong demand has arisen for realization of a pitch shifter for performing, in real time, pitch shift processing for obtaining an effect that a voice produced at a microphone of, e.g., karaoke equipment is converted into a sound having another pitch, and the sound is reproduced from a loudspeaker.

As a prior art apparatus that realizes the above-mentioned pitch shift processing, a pitch shifter utilizing digital signal processing is known. In such a digital pitch shifter, input waveform data (sound signal) is sequentially written at addresses continuous from a predetermined start address of a memory on the basis of write addresses, which are incremented by an increment width "1" at every sampling timing. In this case, when the write address reaches a predetermined address, it returns to the start address to continue a write access. Simultaneously with this operation, the waveform data written in the memory is read out and output on the basis of read addresses, which are sequentially incremented by an increment width (address width) corresponding to a pitch shift amount. For example, if the pitch frequency is to be doubled, the increment width is set to be "2". In contrast to this, when the pitch frequency is to be halved, the increment width is set to be "0.5". In this case, since the addresses of the memory are integers, waveform data read out from two adjacent integer addresses is interpolated to generate waveform data corresponding to addresses incremented by the increment width of the real number.

In addition to the above-mentioned prior art, a digital pitch shifter, which changes the ratio itself of a clock speed set when input waveform data is A/D-converted, and is written in a memory to a clock speed set when waveform data is read out from the memory, and is D/A-converted, according to the pitch shift amount, is also known.

In the digital pitch shifter having the above-mentioned basic arrangement, since the advance speed of a write address is different from that of a read address of the memory, the read address may overtake the write address, and vice versa. When such a phenomenon occurs, readout waveform data becomes discontinuous over time, and click noise is mixed in an output sound, thus considerably deteriorating sound quality.

As the first prior art for technique preventing this phenomenon, a technique for causing, near the above-mentioned discontinous point, a read address to jump to a zero-crossing point of data (a point where the amplitude of waveform data becomes zero) so as to connect waveform data at the zero-crossing point, is known (Published Unexamined Japanese Patent Application No. 60-35795).

As the second prior art technique, the following technique is proposed (Published Unexamined Japanese Patent Application No. 60-159799). In this prior art technique, waveform data is written in the same manner as in the above-mentioned basic arrangement. In contrast to this, waveform data is simultaneously read out from two read addresses, which are designated to be separated by a predetermined address interval of the memory. Normally, waveform data read out from the first read address is output. When the difference between the first read address and the write address falls within a range of difference corresponding to a predetermined time interval, two items of waveform data read out from the first and second read addresses are cross-faded according to a predetermined function, thereby generating output waveform data. In this case, cross-fade processing is performed, so that the mixing ratio of waveform data read out from the first read address is gradually decreased, and the mixing ratio of waveform data read out from the second read address is gradually increased. Immediately before the first read address coincides with the write address, the second read address is replaced with the first read address, and thereafter, waveform data read out from the replaced new read address is output. Upon repetition of the above operations, pitch shift processing is so executed as to decrease the ratio of waveform data components near the above-mentioned discontinuous point in output waveform data as much as possible. Thus, generation of click noise can be minimized.

However, in an actual application of the first prior art technique, noise cannot be removed perfectly.

On the other hand, the second prior art technique can considerably suppress the click noise. In the second prior art technique, the cross-fade processing is started when the difference between the first read address and the write address falls within the range of difference corresponding to the predetermined time interval. In order to obtain a natural output sound, when the pitch shift amount is changed, the value of the address difference corresponding to the predetermined time interval must also be changed. For this reason, the second prior art technique requires means for changing a setting value of the address difference according to the pitch shift amount, and means for determining whether or not the difference between the first read address and the write address coincides with the above-mentioned setting value. For this reason, control is complicated, and the circuit size is increased.

SUMMARY OF THE INVENTION

The present invention has been made in consideration of the above situation, and has as its object to provide a digital pitch shifter, which can eliminate generation of noise independently of the pitch shift amount, and can stably perform pitch shift processing with a simple arrangement.

More specifically, the present invention is premised on a digital pitch shifter wherein waveform data is cyclically and sequentially written on a predetermined storage area on storage means, and simultaneously with the write operation, the waveform data is cyclically read out from the storage area by an increment width corresponding to a designated pitch shift amount, thus executing pitch shift processing of waveform data.

The digital pitch shifter of the present invention comprises waveform data write means for sequentially and cyclically writing input waveform data while sequentially and cyclically designating write addresses, which are changed by an increment width "1", to the storage means. This means repeats an address designation operation for designating write addresses from the start address of the predetermined storage area while incrementing the write address by one address at, e.g., every sampling timing, and for, when the write address reaches the end address of the storage area, returning the address to the start address.

The digital pitch shifter of the present invention also comprises first waveform data acquiring means for sequentially and cyclically acquiring first waveform data by sequentially and cyclically designating first read addresses, which are changed by an increment width corresponding to a designated pitch shift amount, to the storage means. The pitch shift amount and the first read address are real numbers. The first waveform data acquiring means designates, to the storage means, an address corresponding to a value of an integer part of the first read address, and an address corresponding to a value obtained by incrementing the former value by "+1" so as to read out two waveform data, and interpolates the two waveform data on the basis of a value of a decimal part of the first read address, thereby acquiring first waveform data. The address designation operation in this case is also cyclically performed in the same manner as that for the write address.

The digital pitch shifter of the present invention comprises second waveform data acquiring means for sequentially and cyclically acquiring second waveform data by sequentially and cyclically designating, to the storage means, second read addresses whose address values relative to the first read address are different by an address value half the total number of addresses of the storage area. The second read address is also a real number. The second waveform data acquiring means designates, to the storage-means, an address corresponding to a value of an integer part of the second read address, and an address to corresponding to a value obtained by incrementing the former value by "+1" so as to read out two waveform data, and interpolates the two waveform data on the basis of a value of a decimal part of the second read address, thereby acquiring second waveform data.

The digital pitch shifter of the present invention further comprises the following cross-fade processing means. More specifically, the cross-fade processing means calculates first address difference data as an address difference between the first read address, and its corresponding write address. The means then calculates second address difference data as an address difference between the second read address, and its corresponding write address. The means executes a cross-fade calculation on the basis of the first and second address difference data, and the first and second waveform data, thereby calculating pitch-shifted output waveform data. More specifically, the cross-fade processing means calculates first cross-fade data by multiplying the first waveform data with a first envelope value obtained based on the first address difference data, and calculates second cross-fade data by multiplying the second waveform data with a second envelope value obtained based on the second address difference data. The means adds these first and second cross-fade data to obtain output waveform data.

In the present invention, read processing of waveform data from the storage means is executed as processing for reading out the first and second waveform data from the first and second read addresses, whose relative address values are different from each other by an address value half the total number of addresses of the storage area.

The cross-fade processing means cross-fades the first and second waveform data at the first and second read addresses, so that as the read address becomes closer to the corresponding write address, the mixing ratio of waveform data corresponding to the read address to output waveform data is decreased, and as the read address is separated from the corresponding write address, the mixing ratio of waveform data corresponding to the read address to output waveform data is increased, thereby generating output waveform data. The mixing ratios of the first and second waveform data are controlled on the basis of the first address difference between the first read address and its corresponding write address, and the second address difference between the second read address and its corresponding write address.

In this manner, according to the present invention, since cross-fade processing is performed for the first and second waveform data on the basis of the address differences between the write addresses and the first and second read addresses regardless of the pitch shift amount, automatically and optimally cross-faded output waveform data can be obtained.

In addition to the above-mentioned arrangement for performing cross-fade processing of two waveform data to obtain output waveform data, the present invention may be further extended to employ the following arrangement.

More specifically, the present invention can be realized as a digital pitch shifter comprising:

waveform storage means for cyclically and sequentially storing input waveform data;

write address signal generating means for generating a write address signal for writing the waveform data at a predetermined rate to said waveform storage means;

read address signal generating means for generating a plurality of read address signals, which are changed at a rate different from that of the write address signal, have an address difference of a designated magnitude therebetween, and are used for reading out the waveform data from the waveform storage means; and processing means for obtaining, on the basis of address differences between the write address signal and the plurality of read address signals, control data, which is changed over time, in correspondence with each read address signal, performing a weighting calculation according to the control data for a plurality of waveform data cyclically read out from the waveform storage means, mixing the weighted waveform data, and outputting the resultant waveform data as waveform data having a pitch obtained by changing a pitch of the input waveform data.

At this time, the read address signal generating means may comprise interpolation means for generating a plurality of read address signals each having an integer part and a decimal part, supplying an address corresponding to a value of the integer part of each read address signal, and an address corresponding to a value obtained by incrementing the former value by "+1" to the waveform storage means so as to read out two waveform data, and interpolating the two waveform data on the basis of the decimal part of the read address signal to obtain one waveform data, thus improving precision of a waveform.

It is obvious for those skilled in the art from the following description of the embodiment that the present invention may adopt other arrangements, modifications, and applications.

BRIEF DESCRIPTION OF THE DRAWINGS

Other objects and arrangements of the present invention will be understood by those who are skilled in the art in the following description of the preferred embodiment of the present invention taken in conjunction with the accompanying drawings, in which:

FIG. 7 is a flow chart showing a cross-fade processing routine;

DETAILED DESCRIPTION OF THE PREFERRED EMBODIMENT

The preferred embodiment of the present invention will be described in detail hereinafter with reference to the accompanying drawings.

Arrangement of Embodiment

Figure 1:
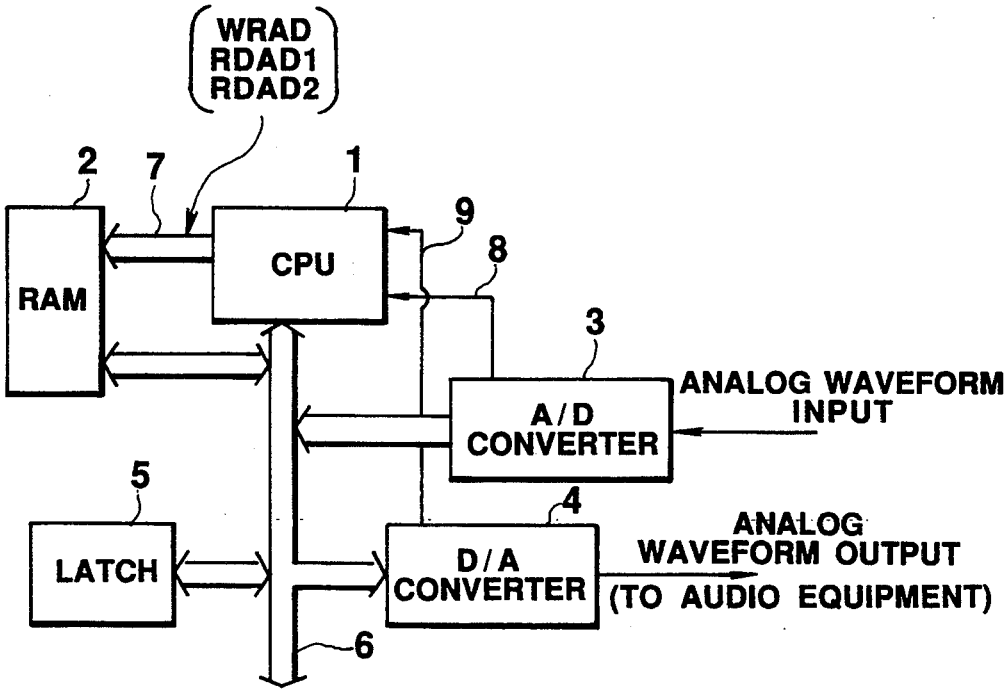
FIG. 1 is a system block diagram of an embodiment according to the present invention.

FIG. 1 is a system block diagram of an embodiment according to the present invention.

In FIG. 1, a CPU (central processing unit) 1 comprises, e.g., a microprocessor, and controls the overall system according to a microprogram stored in an internal program ROM (not shown). This program may be loaded from, e.g., an external ROM.

The CPU 1 comprises an internal multiplier and adder/subtracter (neither are shown), and performs an interpolation calculation, an address calculation, and the like. The CPU 1 also comprises a write address register WRT, a read address register RD-1, and a read address register RD-2 (none of them are shown). These registers hold a write address (WRAD), a read address 1 (RDAD1), and a read address 2 (RDAD2), which are calculated in the CPU 1.

The CPU 1 is connected, through a 16-bit data bus 6, to a RAM (random access memory) 2, an A/D converter (analog/digital signal converter) 3, a D/A converter (digital/analog signal converter) 4, and a LATCH (latch circuit) 5.

The A/D converter 3 samples an externally input analog signal waveform at a predetermined interval, converts it into digital waveform data, and outputs the digital waveform data onto the data bus 6.

The RAM 2 sequentially stores the digital waveform data obtained by the A/D converter 3 at every sampling timing at address positions designated by the write addresses (WRAD) output from the write address register WRT in the CPU 1 through a 15-bit address bus 7. The stored digital waveform data is sequentially read out, through the data bus 6, from address positions designated by the read addresses 1 (RDAD1) and the read addresses 2 (RDAD2) from the read address registers RD-1 and RD-2 in the CPU 1 through the address bus 7.

Figure 2:
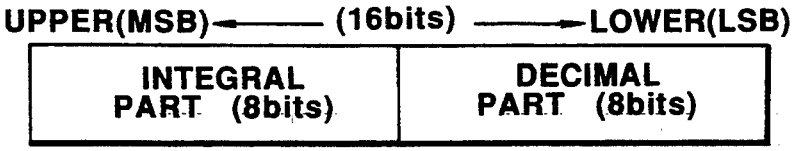
FIG. 2 shows a data format in a latch shown in FIG. 1.

As shown in FIG. 2 (to be described later), the latch circuit 5 has a 16-bit arrangement, and selectively stores an arbitrarily set pitch shift amount (a numerical value indicating a magnification used for converting the pitch of the input waveform into another pitch) in an 8-bit integer part and an 8-bit decimal part. The pitch shift amount data is added in turn to the read address 1 (RDAD1) and the read address 2 (RDAD2) in the two read address registers RD-1 and RD-2.

The D/A converter 4 converts pitch-shifted digital waveform data supplied from the RAM 2 at the same sampling period as that of the A/D converter 3 into analog waveform data, and outputs the analog waveform data to an external audio apparatus (constituted by an amplifier, a loudspeaker, and the like).

A signal (AD) 8 is a flag for informing to the CPU 1 that analog-to-digital converted (A/D) data of the A/D converter 3 is ready to be output.

A signal (DA) 9 is a flag for informing to the CPU 1 that the D/A converter 4 is ready to receive new digital data.

FIG. 2 shows the data format of the latch circuit 5. This data is pitch shift amount data set for pitch shift processing, as described above.

More specifically, when the pitch is to be decreased by one octave, i.e., when the frequency is to be halved, a value "0.5" is set to have an integer part "00000000" ("00" in hexadecimal notation) and a decimal part "10000000" ("80" in hexadecimal notation). When the pitch is to be increased by one octave, i.e., when the frequency is to be doubled, a value "2.0" is set to have an integer part "00000010" ("02" in hexadecimal notation) and a decimal part "00000000" ("00") hexadecimal notation). Similarly, for 1.5 times, "0180" in hexadecimal notation is set, and for 1.3 times, "014C" in hexadecimal notation is set. Note that in this embodiment, the latch circuit 5 can assume a value up to 2.0.

The above-mentioned pitch shift amount data is added in turn to the read address 1 (RDAD1) from the read address register RD-1, and the read address 2 (RDAD2) from the read address register RD-2 in the CPU 1, and thereafter, these sum addresses are used in an interpolation calculation for pitch-converting a waveform. In this case, the read addresses 1 (RDAD1) and 2 (RDAD2) are respectively data having precision of 16 bits for an integer part and 8 bits for a decimal part.

Operation Principle of Embodiment

The operation principle of the embodiment of the present invention with the above arrangement will now be described.

First, the relationship among the write address (WRAD) of the write address register WRT, the read address 1 (RDAD1) of the read address register RD-1, the read address 2 (RDAD2) of the read address register RD-1, and the address space of the RAM 2 will be described below.

FIGS. 7A to 7D show changes in address position when the read addresses 1 (RDAD1) and 2 (RDAD2), and the write address (WRAD) are sequentially moved in the address space of the RAM 2 (to be simply referred to as an "address space" hereinafter) used in pitch shift processing. The address space used in this pitch shift processing has addresses 0000(H) to 8000(H). (H) represents hexadecimal notation. Each address in the address space is designated by supplying lower 15 bits of the 16-bit integer part of the read address 1 (RDAD1) or 2 (RDAD2) or of the write address (WRAD) to the RAM 2 through the address bus 7. Note that each of the read addresses 1 (RDAD1) and 2 (RDAD2) further includes an 8-bit decimal part. The function of the decimal part data will be described later.

Figure 7A:
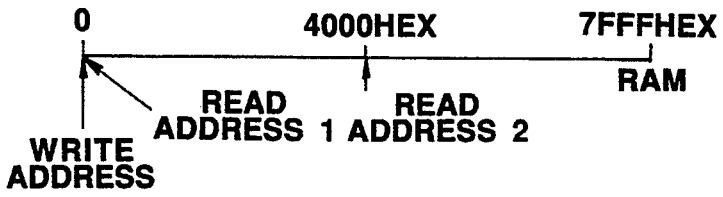
FIGS. 7A to 7D are views for explaining changes in address.

FIG. 7A illustrates an initial state. The write address (WRAD) and the read address 1 (RDAD1) are set to be 0000(H), and the read address 2 (RDAD2) is set to be 4000(H) indicating an address value half the end address 7FFF(H) of the address space.

Figure 7B:
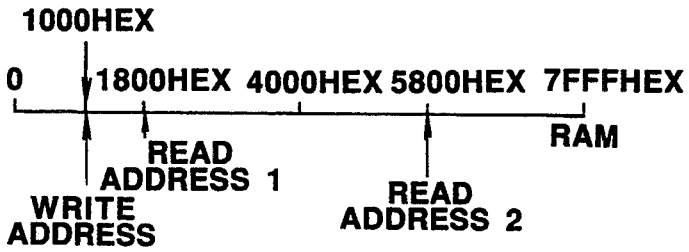

FIG. 7B shows a state wherein 4,096 samples of digital waveform data are processed, and the write address (WRAD) reaches 1000(H). In this case, since the pitch shift amount is set to be 1.5 times, the read address 1 (RDAD1) is advanced from the write address (WRAD). As will be described later, the same applies, as a whole, to a case wherein the changed pitch is lower than an original pitch.

Figure 7C:
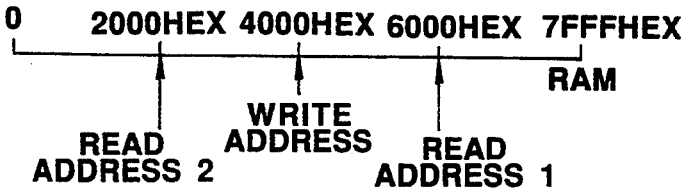

FIG. 7C shows a case wherein 16,384 samples of digital waveform data are processed, and the write address (WRAD) reaches 4000(H), i.e., the middle position in the address space. In this case, the read address 2 (RDAD2) is about to catch up the write address (WRAD).

Figure 7D:
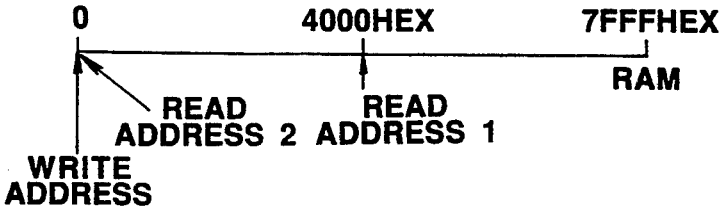

FIG. 7D shows a state wherein the write address (WRAD) goes round the address space, and is returned to 0000(H). FIGS. 7D and 7A illustrate substantially the same state, except that the positions of the read addresses 1 (RDAD1) and 2 (RDAD2) are replaced. Thereafter, the states shown in FIGS. 7A to 7C are repeated.

Figure 10:
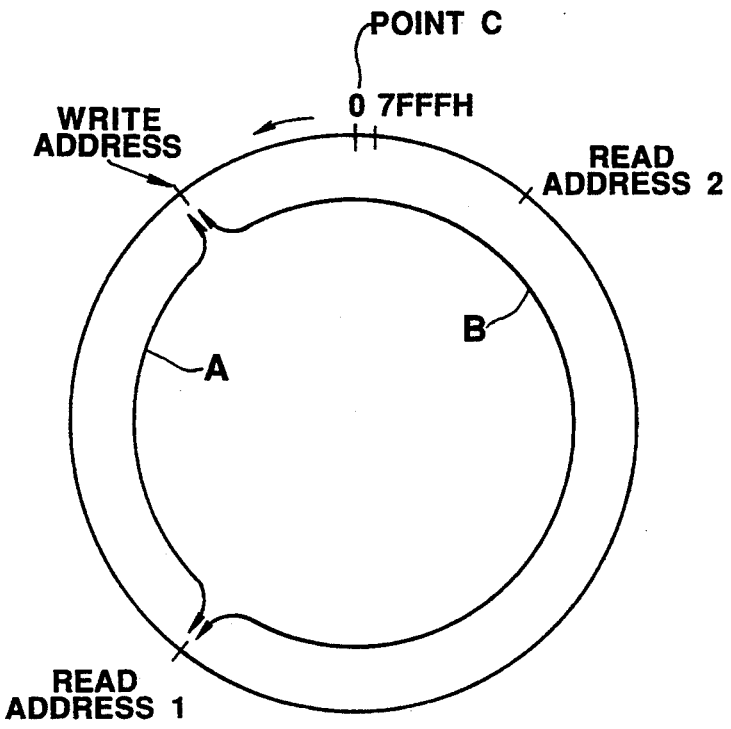
FIG. 10 is a view for explaining an address space.

As described above, the three address values, i.e., the write address (WRAD), and the read addresses 1 (RDAD1) and 2 (RDAD2) are circulated between 0000(H) and 7FFF(H), as illustrated in FIG. 10.

The address difference between the read address 1 (RDAD1) and the write address (WRAD), and the address difference between the read address 2 (RDAD2) and the write address (WRAD) will be examined below. For example, in FIG. 10, two address differences A and B exist between the read address 1 (RDAD1) and the write address (WRAD). The smaller address difference A will always be considered below. The same applies to the address differences between the read address 2 (RDAD2) and the write address (WRAD). Therefore, two kinds of address differences, i.e., the address difference corresponding to the read address 1 (RDAD1), and the address difference corresponding to the read address 2 (RDAD2), never exceed a value "4000(H)" corresponding to the middle address of the address space. The above-mentioned two kinds of address differences are repetitively changed between 0000(H) and 4000(H) by a predetermined change amount unless the pitch shift amount is 1.0.

Figure 8A:
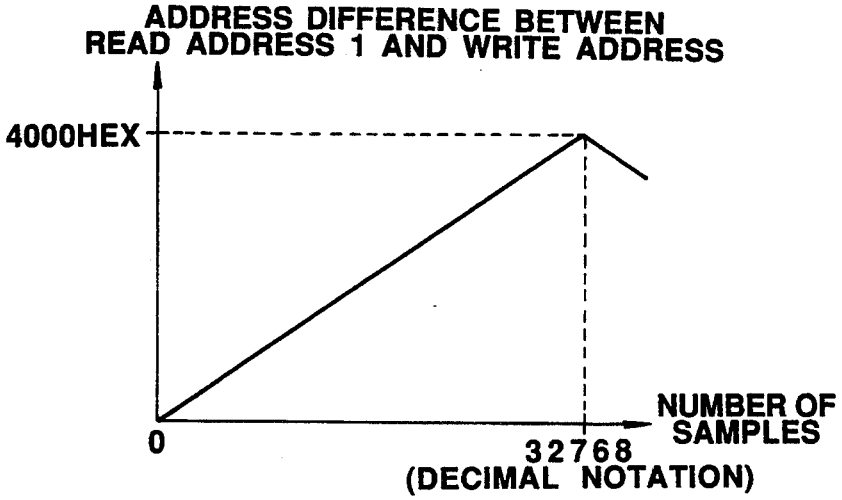
FIGS. 8A and 8B are graphs (part 1) showing characteristics of a change in address difference.
Figure 8B:
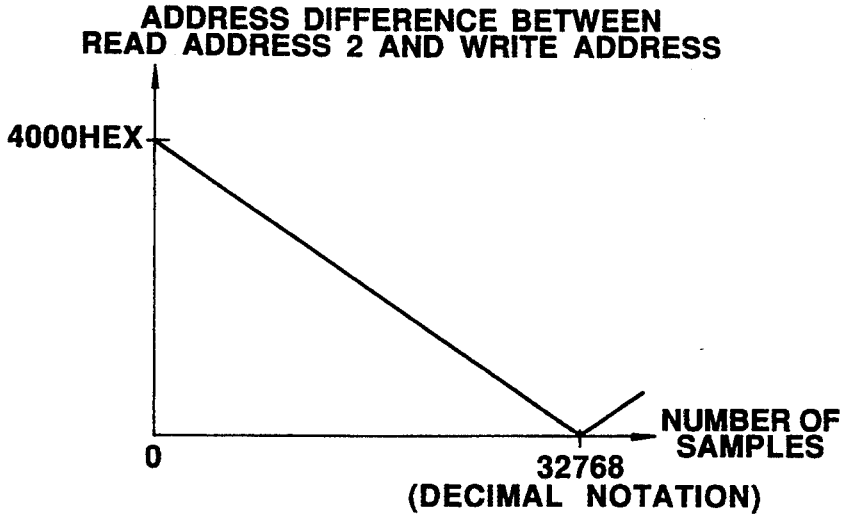

FIGS. 8A and 8B show change characteristics of the address differences when the pitch shift amount is 1.5 times as in FIGS. 7A to 7D. FIG. 8A shows the change characteristics of the address difference between the read address 1 (RDAD1) and the write address (WRAD), which characteristics are obtained until 32,768 samples of input waveform data are written in the RAM 2 around the address space) on the basis of the write addresses (WRAD). FIG. 8B similarly shows a change in address difference between the read address 2 (RDAD2) and the write address (WRAD). When the sampling operation further progresses, the above-mentioned two kinds of address differences respectively have characteristics, as shown in (A) and (B) in FIG. 9. More specifically, the number of samples to be written in the RAM 2 based on the write addresses (WRAD) is 65,536 during one period for which the above-mentioned two kinds of address differences are respectively changed in the order of 0000(H)→4000(H)→0000(H) in (a) in FIG. 9, and in the order of 4000(H)→0000(H)→4000(H) in (b) in FIG. 9.

Figure 9:
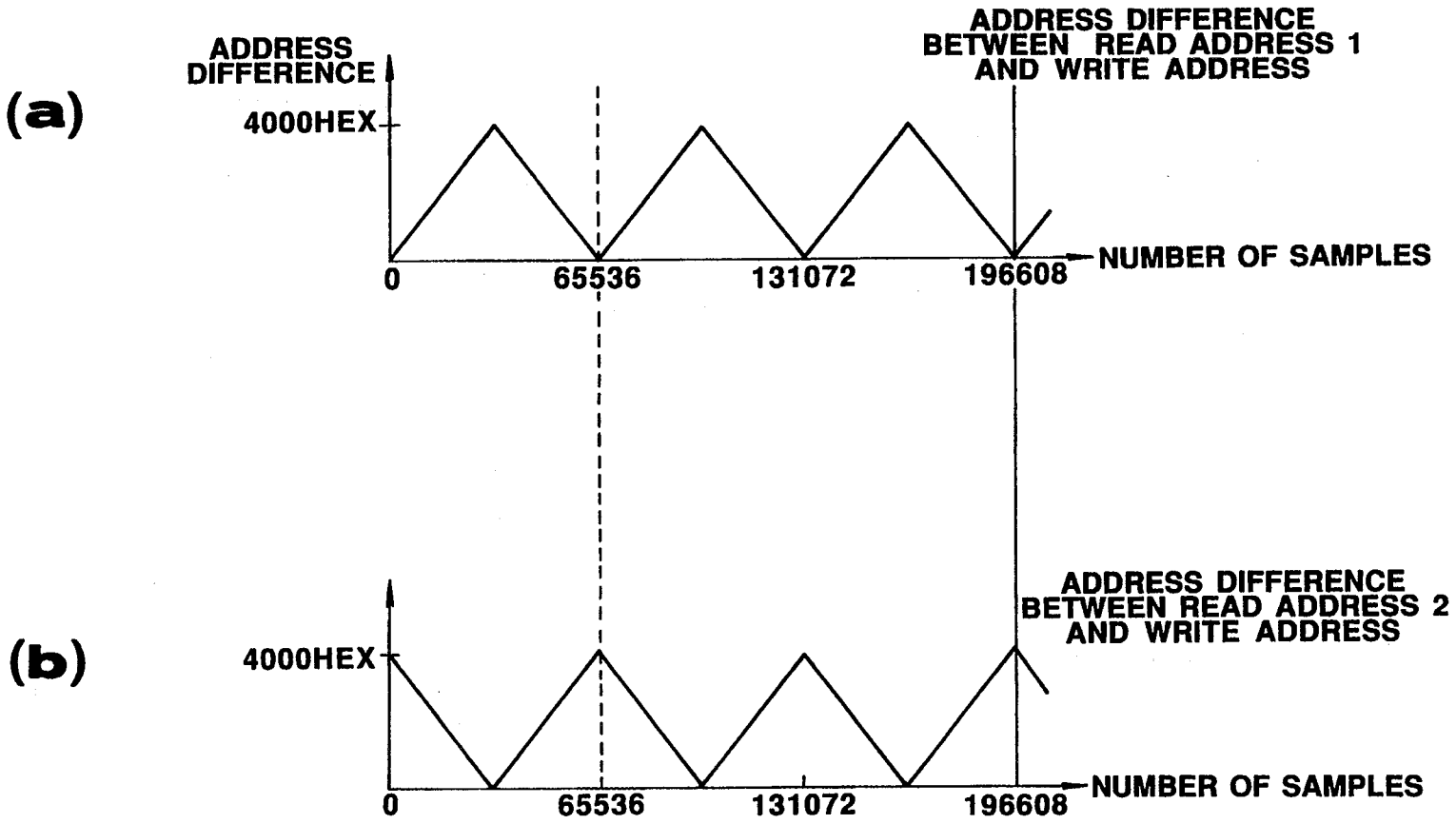
FIG. 9 is a graph (part 2) showing characteristics of a change in address difference.

When the pitch shift amount is changed from 1.5 times described above to another numerical value, the number of samples sampled by the write addresses (WRAD) during one period for which the above-mentioned two kinds of address differences are respectively changed in the order of 0000(H)→4000(H)→0000(H) in (a) in FIG. 9, and in the order of 4000(H)→0000(H)→4000(H) in (b) in FIG. 9, is not 65,536, but is set to be a value corresponding to the set pitch shift amount. However, the change characteristics themselves have a similar pattern (triangular waveform) as shown in FIG. 9.

Based on the above-mentioned fact, in this embodiment, two items of waveform data are parallelly read out from the read addresses 1 (RDAD1) and 2 (RDAD2) of the RAM 2 at every sampling timing (in practice, these items of data are subjected to interpolation processing), and an address difference between the read address 1 (RDAD1) and the write address (WRAD), and an address difference between the read address 2 (RDAD2) and the write address (WRAD) are obtained. Two values obtained by normalizing these two kinds of address differences are multiplied as envelope values with the amplitudes of the two waveform data, and items of two items of waveform data as a result of multiplication are added to each other, thereby generating output waveform data. More specifically, in this embodiment, two items of waveform data read out from the two read addresses are cross-faded to generate output waveform data in the same manner as in the second prior art. However, the cross-fade processing is always performed unlike in the second prior art that executes the cross-fade processing during only a predetermined period.

In the cross-fade processing according to this embodiment, the address difference approaches zero near a discontinuous point of waveform data where one of the read addresses (RDAD1 and RDAD2) approaches the write address (WRAD). For this reason, the mixing ratio of waveform data components near the discontinuous point to output waveform data is decreased, and click noise at the discontinuous point can be removed. Since the cross-fade processing is always executed on the basis of the two address differences independently of the pitch shift amount, complicated controls for executing cross-fade processing during only a period determined according to the pitch shift amount need not be executed unlike in the second prior art.

Detailed Operation of Embodiment

The detailed operation of the embodiment with the above-mentioned arrangement will be described below with reference to the flow charts shown in FIGS. 3 to 6.

Figure 3:
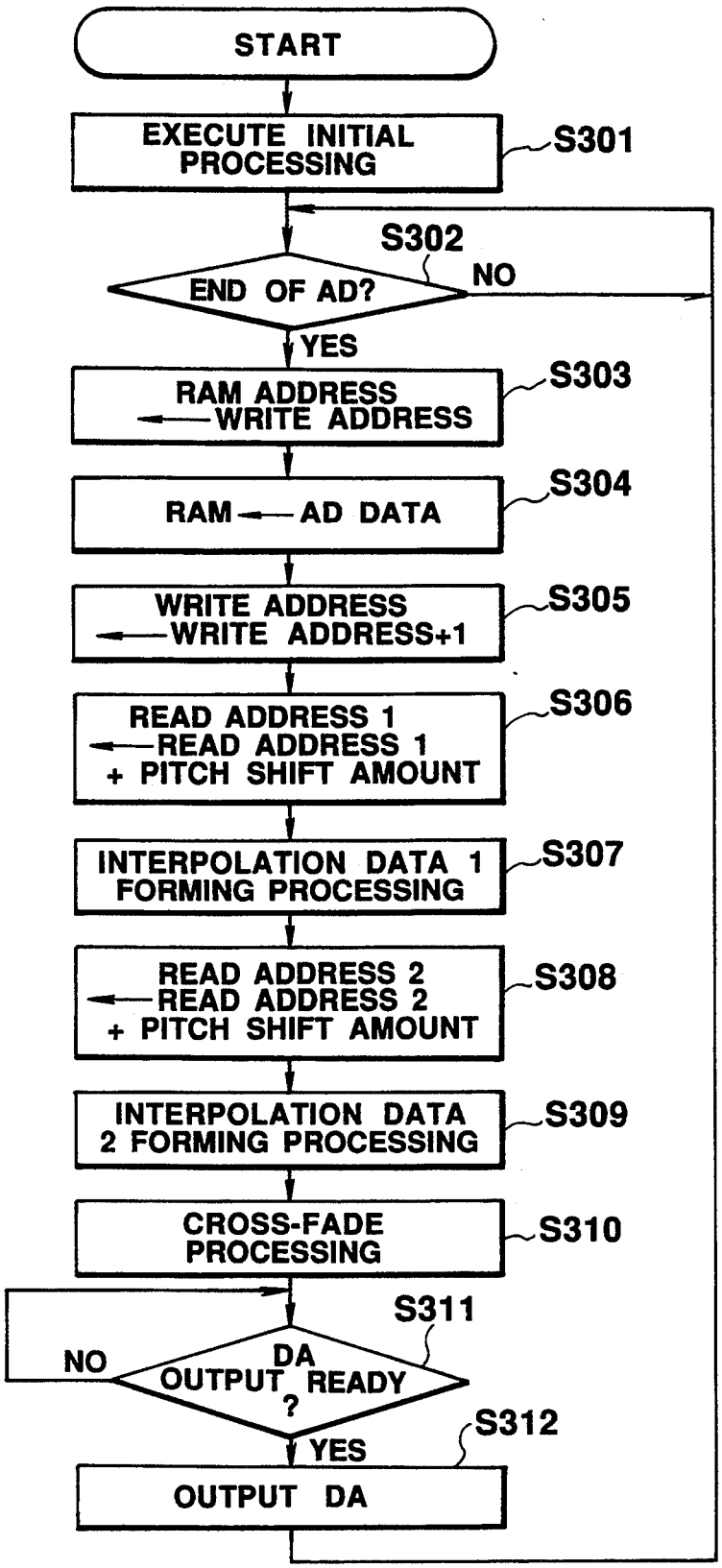
FIG. 3 is a general flow chart.

FIG. 3 is a general flow chart of processing executed by the CPU 1 shown in FIG. 1, and FIGS. 4 to 6 are subroutine flow charts respectively showing processing operations in steps S307, S309, and S310 in the general flow chart of FIG. 3. These operations are realized as operations for executing the program stored in the internal ROM (not shown) of the CPU 1.

In FIG. 3, initial processing is executed (step S301).

In this processing , the storage contents of the RAM 2 (FIG. 1), and the A/D and D/A converters 3 and 4 (FIG. 1) are initialized, the flags 8 (AD) and 9 (DA) (FIG. 1) are cleared, and so on. In addition, pitch shift amount data (PDT) is also set in the latch circuit 5. This data is set by operating a setting volume on a console (not shown) by a user. As has already been described above in the arrangement, if the pitch shift amount is, e.g., 1.5 times, data PDT is set to be 0180(H).

In this initial processing, the write address register WRT and the read address registers RD-1 and RD-2 are initialized. The write address value WRAD set in the write address register WRT consists of only a 16-bit integer part, and is initialized to 0000(H), as has been described above with reference to FIGS. 7A to 7D. The address values RDAD1 and RDAD2 set in the two read address registers RD-1 and RD-2 must have a difference therebetween, corresponding to an address value half the total number of addresses of the address space of the RAM 2 used in the pitch shift processing, as has been described above with reference to FIGS. 7A to 7D. In this embodiment, the total number of addresses of the address space used in the pitch shift processing is 8000(H) addresses, as described above. For this reason, the initial value of the 16-bit integer part of the address value RDAD1 in the read address register RD-1 is set to be 0000(H), and the initial value of the 16-bit integer part of the address value RDAD2 in the read address register RD-2 is set to be 4000(H). Note that the initial value of the 8-bit decimal part of each read address is set to be 00(H).

After the initial processing in step S301, the control waits until a timing at which the flag AD (the signal 8 in FIG. 1) indicates the end of A/D conversion for one sample by the A/D converter 3, so as to determine whether or not conversion from an input signal into digital data by the A/D converter 3 is completed (step S302).

If it is determined in step S302 that the flag AD indicates the end of conversion, lower 15 bits of the 16-bit integer part of the write address (WRAD) in the write address register WRT are output onto the address bus 7 shown in FIG. 1, and are supplied to the RAM 2 (step S303).

Subsequently, the input digital data after the conversion is transferred from the A/D converter 3 to the RAM 2 through the data bus 6, and is stored at the address supplied to the RAM 2 in step S303 (step S304).

The write address (WRAD) of the write address register WRT is incremented by "+1", thus advancing the write address (WRAD) for the next input waveform data by one address (S305).

In this manner, processing operations in steps S302 to S305 are performed at each processing timing, and input waveform data converted into digital data by the A/D converter 3 is sequentially stored at addresses 0000(H) to 7FFF(H) of the address space of the RAM 2. The write address register WRT consists of a 16-bit integer part, as described above. However, an address supplied to the RAM 2 corresponds to lower 15 bits of the integer part. Therefore, while the write address (WRAD) is sequentially incremented, and its value changes between 0000(H) and 7FFF(H), an address corresponding to the value is supplied onto the RAM 2. However, when the write address (WRAD) is further incremented by "+1" from 7FFF(H), and reaches 8000(H), the address value supplied onto the RAM 2 is returned to 0000(H). Similarly, the address value supplied to the RAM 2 as lower 15 bits of the write address (WRAD) becomes a value circulated between 0000(H) and 7FFF(H). Thus, input waveform data is cyclically stored between the addresses 0000(H) and 7FFF(H) of the address space of the RAM 2.

When the RAM 2 is accessed by the read addresses 1 (RDAD1) and 2 (RDAD2), since lower 15 bits of the 16-bit integer part of each read address are supplied to the RAM 2, waveform data stored between the addresses 0000(H) and 7FFF(H) of the address space of the RAM 2 is cyclically read out.

In order to form first interpolation data, the pitch shift amount data PDT set in the latch circuit 5 is added to the read address 1 (RDAD1) of the read address register RD-1 (step S306). As for calculation precision in this case, as described above, the read address 1 (RDAD1) consists of 16 bits for an integer part and 8 bits for a decimal part, and the pitch shift amount data PDT consists of 8 bits for both integer and decimal parts. Interpolation data 1 forming processing is executed using the read address (RDAD1) obtained in this manner (step S307).

In order to realize pitch shift processing with a fine change width, it is not sufficient to change the increment width (pitch shift amount) of readout data with precision of each sampling position of waveform data stored in the RAM 2 when waveform data is read out from the RAM 2. More specifically, the increment width must be processed not as an integer value but as a real number value. For this reason, the read address 1 (RDAD1) is expressed as a real number value by a 16-bit integral part and an 8-bit decimal part. When the decimal part is not 00(H), waveform data designated by the read address 1 (RDAD1) does not exist on the RAM 2. Thus, in this embodiment, two items of existing waveform data are read out from an address designated by the 16-bit integer part of the read address 1 (RDAD1), and an address designated by a value obtained by incrementing the former address by "+1", and waveform data designated by the read address 1 (RDAD1) of the real number value is formed by an interpolation calculation using these two items of existing waveform data, and the 8-bit decimal part of the read address 1 (RDAD1).

These operations are performed in the interpolation data 1 forming processing in step S307. This processing will be described in detail below with reference to the flow chart shown in FIG. 4.

The RAM 2 is accessed by an address value of the 16-bit integer part of the read address 1 (RDAD1) of the read address register RD-1, which value is formed in step S306 in FIG. 3 (step S401).

Thus, first waveform data (readout data 1) is read out from the RAM 2 (step S402).

Subsequently, the RAM 2 is accessed by an address value obtained by incrementing the value of the integer part of the read address 1 (RDAD1) of the read address register RD-1 by "+1" (step S403).

Thus, second waveform data (readout data 2) is read out from the RAM 2 (step S404).

Subsequently, a difference value (difference data 1) between the two waveform data is calculated (step S405).

The difference data 1 is multiplied with a value of the decimal part of the above-mentioned read address 1 (RDAD1), and the product is added to the readout data 1, thus obtaining interpolation data 1 (step S406).

In this manner, waveform data corresponding to the read address 1 (RDAD1) designated as a real number value is obtained as the interpolation data 1.

Referring back to the flow chart shown in FIG. 3, in order to form the second interpolation data, the pitch shift amount data PDT set in the latch circuit 5 is added to the read address 2 (RDAD2) of the read address register RD-2 (step S308). As for calculation precision of the read address 2 (RDAD2), its integer part consists of 16 bits, and its decimal part consists of 8 bits. Interpolation data 2 forming processing is executed in the same manner as for the interpolation data 1 (step S309).

Figure 4:
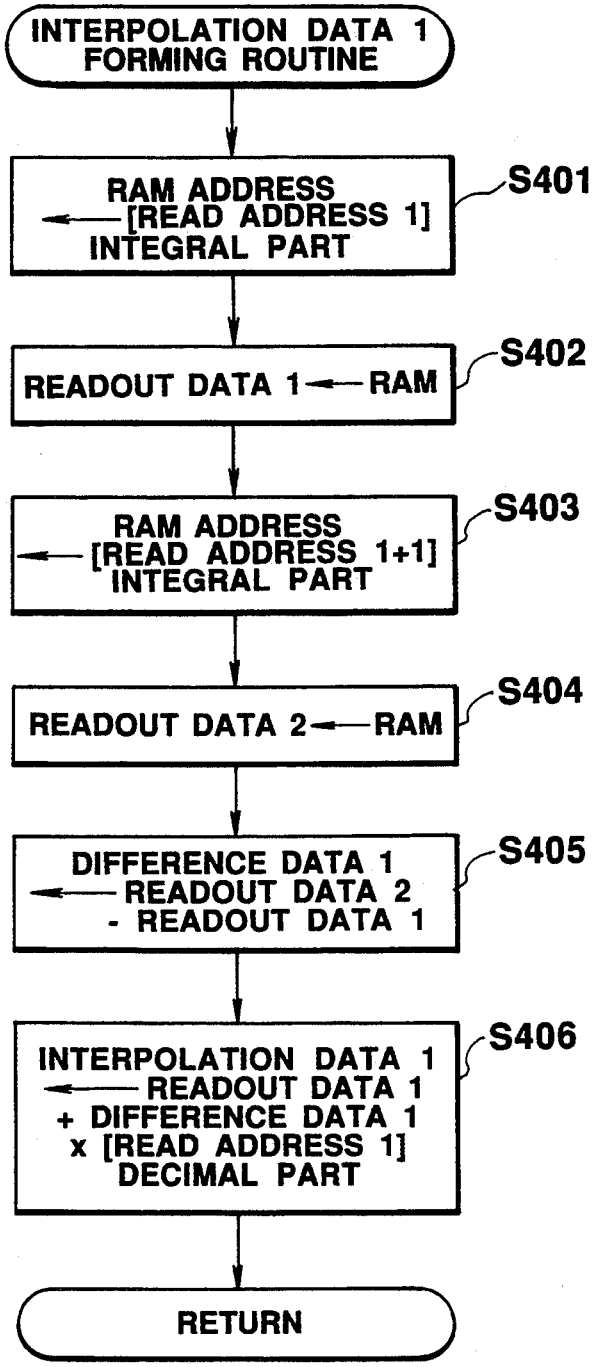
FIG. 4 is a flow chart showing an interpolation data 1 forming routine.
Figure 5:
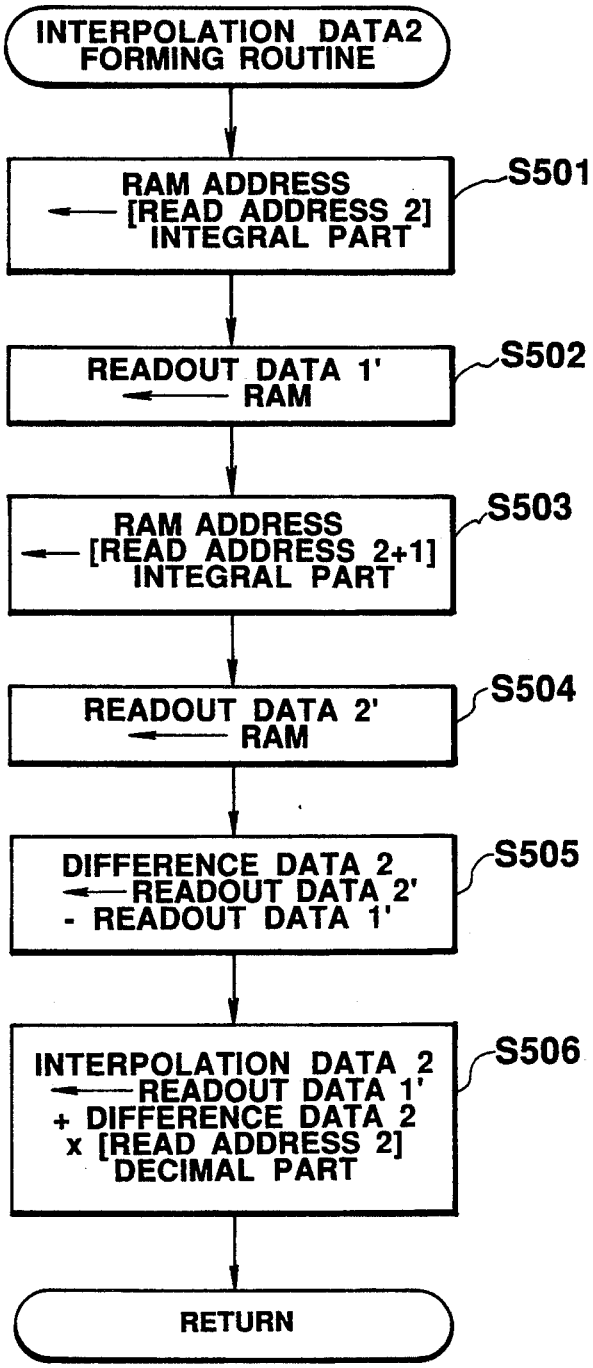
FIG. 5 is a flow chart showing an interpolation data 2 forming routine.

This processing is shown in the flow chart of FIG. 5 similar to FIG. 4. Interpolation data 2 corresponding to the read address 2 (RDAD2) designated as a real number value is obtained by an interpolation calculation (steps S501 to S506).

In this manner, the two interpolation data 1 and 2 respectively corresponding to the read address 1 (RDAD1), and the read address 2 (RDAD2) indicating an address, which is always different from the read address 1 (RDAD1) by a value corresponding to an address value "4000(H)" half the whole cyclic storage area of the RAM 2, can be obtained.

After the two items of interpolation data 1 and 2 respectively corresponding to the two read addresses are obtained in steps S306 to S309 in FIG. 3 at every sampling timing, as described above, pitch-shifted data is formed by cross-fade processing (to be described later) using the two interpolation data (step S310).

Subsequently, the control waits until the flag DA indicates that the D/A converter 4 is ready to receive new digital data (step S311). Thereafter, the pitch-shifted waveform data formed in step S310 is output to the D/A converter 4 (step S312). Then, a pitch-converted sound is externally produced from the D/A converter 4 through an amplifier, a loudspeaker (neither are shown), and the like.

Upon repetition of steps S302 to S312, pitch shift processing is realized.

Finally, the cross-fade processing in step S310 in FIG. 3 will be described in detail below with reference to the flow chart shown in FIG. 6. In this processing, internal address difference registers 1-1, 1-2, 2-1, and 2-2 (not shown), arranged in the CPU 1, for storing address differences between the write address (WRAD), and the read addresses 1 (RDAD1) and 2 (RDAD2), are used. Note that address difference data stored in these registers is expressed by real number values each consisting of a 16-bit integer part and an 8-bit decimal part since the read addresses 1 (RDAD1) and 2 (RDAD2) are real number values, as described above.

Figure 6:
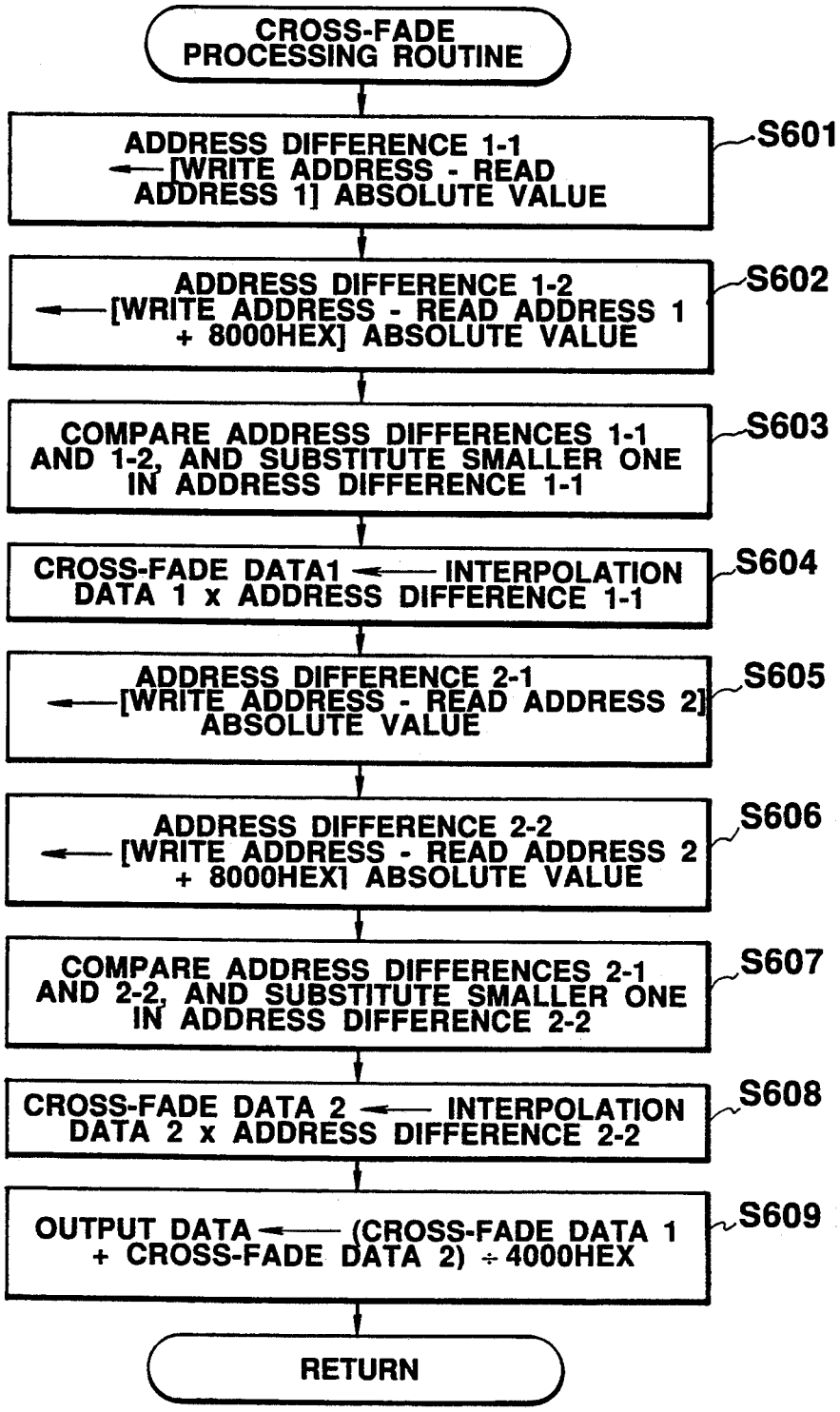

In FIG. 6, the read address 1 (RDAD1) is subtracted from the write address (WRAD), and the absolute value of the difference therebetween is stored in the address difference register 1-1 (step S601). This calculation can yield an address difference (a difference A in FIG. 10) between the write address (WRAD) and the read address 1 (RDAD1), which difference does not include a point (a position of "0" (0000(H)) in FIG. 10; to be referred to as a point C hereinafter) where the address space is circulated and closed.

Then, the read address 1 (RDAD1) is subtracted from the write address (WRAD), the difference is added to 8000(H), and the absolute value of the sum is stored in the address difference register 1-2 (step S602). This calculation is equivalent to a calculation "(WRAD−0)+(8000−RDAD1)". Therefore, an address difference between the point C and WRAD is calculated by a subtraction term (WRAD−0), and an address difference between RDAD1 and the point C is calculated by a subtraction term (8000−RDAD1). Thereafter, these two address differences are added to each other to obtain an address difference (a difference B in FIG. 10) between the write address (WRAD) and the read address 1 (RDAD1), which difference includes the point C.

Subsequently, the values in the two address difference registers 1-1 and 1-2 are compared to each other, and the smaller value is stored in the address difference register 1-1 (step S603). In this manner, the address difference having the change characteristics shown in (a) in FIG. 9, described above, is obtained in the address difference register 1-1.

The address difference obtained in the address difference register 1-1 is multiplied with the interpolation data 1 obtained in step S307 in FIG. 3, thus obtaining cross-fade data 1 (step S604). More specifically, waveform data having the address difference with characteristics shown in (a) in FIG. 9 as an envelope value is obtained as the cross-fade data 1.

In steps S605 to S608, the same operations as those in processing in steps S601 to S604 are performed for the read address 2 (RDAD2).

More specifically, a smaller address difference from the write address (WRAD) is adopted, thus obtaining an address difference based on the change characteristics shown in (b) in FIG. 9 in the address difference register 2-2 (step S607). The address difference obtained in the address difference register 2-2 is multiplied with the interpolation data 2 obtained in step S309 in FIG. 3, thereby obtaining cross-fade data 2 (step S608). More specifically, waveform data having the address difference with characteristics shown in (b) in FIG. 9 as an envelope value is obtained as the cross-fade data 2.

Finally, the items of cross-fade data 1 and 2 are added to each other, and the sum is divided with a maximum address difference 4000(H). This quotient is used as output data to the D/A converter 4 (step S609).

The cross-fade processing in step S312 in FIG. 3 is executed as a series of processing operations described above.

Since the read address 2 (RDAD2) is different from the read address 1 (RDAD1) by "4000(H)" as it is set in the initial processing, the change characteristics of its address difference are as shown in (b) in FIG. 9, as has already been described above. Therefore, when the address difference 1-1 of the read address 1 (RDAD1) is added to the address difference 2-2 of the read address 2 (RDAD2), 4000(H) can be obtained. These two address differences have a relationship to compensate for the maximum value 4000(H) therebetween.

As for the cross-fade data 1 and 2 having these two address differences as envelope values, when one address difference is decreased as one address approaches the write address (WRAD), i.e., when the envelope value is decreased, the other address difference is increased to compensate for the one address difference. In other words, the envelope value is increased.

When these items of two waveform data are added to each other, the envelope value of one cross-fade data at a waveform discontinuous point, where one of the read addresses crosses the write address (WRAD), is almost zero, and the envelope value of the other cross-fade data, which compensates for this is maximized.

More specifically, cross-fade data passing the waveform discontinuous point constitutes almost no sound data since its envelope value is almost zero. In contrast to this, the other cross-fade data is always formed based on intermediate one of data written in the address space at that time, and hence, does not suffer from a waveform discontinuous point. In addition, the envelope value of this cross-fade data is maximum, as described above. For these reasons, the cross-fade data becomes data which is most dominantly produced as a sound in the cross-fade processing.

Thus, occurrence of waveform discontinuous points can be prevented.

In step S609 described above, the sum of the two cross-fade data is divided with the maximum address difference 4000(H). This processing is to perform normalization for obtaining the sum = 1 since the sum of the address difference 1-1 of the read address 1 (RDAD1) and the address difference 2-2 of the read address 2 (RDAD2) becomes 4000(H).

According to the present invention, cross-fade processing can always be performed for the first and second waveform data on the basis of the address differences between the write address, and the first and second read addresses independently of the pitch shift amount. Therefore, automatically cross-faded output waveform data can be obtained.

In this manner, according to the present invention, the cross-fade processing can be realized by simply calculating address differences and multiplying these differences with two waveform data as envelope values. Therefore, high-quality pitch-shifted waveform data can be obtained by an inexpensive apparatus.

The preferred embodiment of the present invention has been described. However, the above embodiment is merely an example, the present invention can adopt various other arrangements, and all the modifications and applications of the present invention fall within this scope. Therefore, the scope of the present invention should be determined by only the appended claims and their equivalents.

What is claimed is:

1. A digital pitch shifter, in which input waveform data is cyclically and sequentially written in a predetermined storage area in a storage means, and simultaneously with a write operation, stored waveform data is cyclically read out from the storage area by an increment width corresponding to a designated pitch shift amount, thereby pitch-shifting the waveform data, comprising:

waveform data write means for sequentially and cyclically writing the input waveform data by sequentially and cyclically designating a write address, which is changed by an increment width 1, to said storage means;

first waveform data acquiring means for sequentially and cyclically acquiring first waveform data by sequentially and cyclically designating a first read address, which is changed by an increment width corresponding to the designated pitch shift amount, to said storage means, said first waveform data acquiring means operating to designate a read address for reading data out of said storage means simultaneously with said writing of the input waveform data by said waveform data write means;

second waveform data acquiring means for sequentially and cyclically acquiring second waveform data by sequentially and cyclically designating a second read address, whose address value relative to the first read address is different by an address value which corresponds to half a total number of addresses of the storage area, to said storage means, said second waveform data acquiring means operating to designate a read address for reading data out of said storage means simultaneously with said reading data out of said storage means by said first waveform data acquiring means and simultaneously with said writing of the input waveform data by said waveform data write means; and cross-fade processing means including means for calculating first address difference data as an address difference between the first read address and a corresponding write address, means for calculating second address difference data as an address difference between the second read address and a corresponding write address, and means for executing a cross-fade calculation on the basis of the first and second address difference data, and the first and second waveform data, so as to calculate pitch-shifted output waveform data.

2. A digital pitch shifter according to claim 1, wherein said cross-fade processing means further comprises:

first calculation means for multiplying the first waveform data with a first envelope value obtained based on the first address difference value, to calculate first cross-fade data;

second calculation means for multiplying the second waveform data with a second envelope value obtained based on the second address difference value, to calculate second cross-fade data; and third calculation means for adding the first and second cross-fade data to each other to calculate the pitch-shifted output waveform data.

3. A digital pitch shifter according to claim 1, wherein:

said first waveform data acquiring means comprises means for reading out two waveform data by designating, to said storage means, an address corresponding to a value of an integer part of the first read address, and an address corresponding to a value obtained by incrementing the former value by +1, and for interpolating the two waveform data on the basis of a value of a decimal part of the first read address, thereby acquiring the first waveform data; and said second waveform data acquiring means comprises means for reading out two waveform data by designating, to said storage means, an address corresponding to a value of an integer part of the second read address, and an address corresponding to a value obtained by incrementing the former value by +1, and for interpolating the two waveform data on the basis of a value of a decimal part of the second read address, thereby acquiring the second waveform data.

4. A digital pitch shifter comprising:

waveform storage means for cyclically and sequentially storing input waveform data;

write address signal generating means for generating a write address signal for writing the input waveform data in said waveform storage means at a predetermined rate;

read address signal generating means for generating a plurality of read address signals, simultaneously with writing of the input waveform data in said waveform storage means by said write address signal generating means, which plurality of read address signals are changed at a rate different from the rate of the write address signal, have an address difference of a designated magnitude therebetween, and which are used for simultaneously reading out waveform data from said waveform storage means; and processing means including means for obtaining control data, which is changed over time, on the basis of address differences between the write address signal and the plurality of read address signals in correspondence with the plurality of read address signals, means for performing a weighting calculation according to the control data for a plurality of waveform data cyclically read out from said waveform storage means by the plurality of read address signals, means for adding the weighted waveform data to each other to obtain sum waveform data, and means for outputting the sum waveform data as output waveform data having a pitch obtained by changing a pitch of the input waveform data.

5. A digital pitch shifter according to claim 4, wherein said read address signal generating means includes means for generating two read address signals to read out first and second waveform data, the two read address signals being generated to have a difference corresponding to an address value half a total number of addresses of said waveform storage means.

6. A digital pitch shifter according to claim 5, wherein said processing means further comprises:

means for executing a crossfade calculation by multiplying the first and second waveform data read out from said waveform storage means by the two read address signals with the control data, which are changed over time; and means for outputting the output waveform data having a changed pitch.

7. A digital pitch shifter according to claim 4, wherein said read address signal generating means further comprises:

interpolation means for generating a plurality of read address signals, each having an integer part and a decimal part;

means for reading out two waveform data by supplying, to said waveform storage means, an address corresponding to a value of the integer part of each read address signal, and an address corresponding to a value obtained by incrementing the former value by +1; and means for interpolating the two waveform data based on a decimal part of the read address signal to obtain the output waveform data.

8. A digital pitch shifting method, in which input waveform data is cyclically and sequentially written in a predetermined storage area in a storage means, and simultaneously with a write operation, stored waveform data is cyclically read out from the storage area by an increment width corresponding to a designated pitch shift amount, thereby pitch-shifting the waveform data, the method comprising:

sequentially and cyclically writing the input waveform data by sequentially and cyclically designating a write address, which is changed by an increment width 1, to said storage means;

sequentially and cyclically acquiring first waveform data by sequentially and cyclically designating a first read address, which is changed by an increment width corresponding to the designated pitch shift amount, to said storage means, said designating of a first read address and reading data out of said storage means occurring simultaneously with said writing of the input waveform data to said storage means;

sequentially and cyclically acquiring second waveform data by sequentially and cyclically designating a second read address, whose address value relative to the first read address is different by an address value which corresponds to half a total number of addresses of the storage area, to said storage means, said designating of a second read address for reading data out of said storage means occurring simultaneously with said designating of a first read address for reading data out of said storage means and simultaneously with said writing of the input waveform data to said storage write means; and cross-fade processing including calculating first address difference data as an address difference between the first read address and a corresponding write address, calculating second address difference data as an address difference between the second read address and a corresponding write address, and executing a cross-fade calculation on the basis of the first and second address difference data, and the first and second waveform data, for calculating pitch-shifted output waveform data.

9. A digital pitch shifting method according to claim 8, wherein said cross-fade processing further comprises:

multiplying the first waveform data with a first envelope value obtained based on the first address difference value, for calculating first cross-fade data;

multiplying the second waveform data with a second envelope value obtained based on the second address difference value, for calculating second cross-fade data; and adding the first and second cross-fade data to each other for calculating the pitch-shifted output waveform data.

10. A digital pitch shifting method according to claim 8, wherein:

said step of acquiring first waveform data comprises reading out two waveform data by designating, to said storage means, an address corresponding to a value of an integer part of the first read address, and an address corresponding to a value obtained by incrementing the former value by +1, and for interpolating the two waveform data on the basis of a value of a decimal part of the first read address, thereby acquiring the first waveform data; and said step of acquiring second waveform data comprises reading out two waveform data by designating, to said storage means, an address corresponding to a value of an integer part of the second read address, and an address corresponding to a value obtained by incrementing the former value by +1, and for interpolating the two waveform data on the basis of a value of a decimal part of the second read address, thereby acquiring the second waveform data.

11. A digital pitch shifting method, comprising:

cyclically and sequentially storing input waveform data in a waveform storage means;

generating a write address signal for writing the input waveform data in said waveform storage means at a predetermined rate;

generating a plurality of read address signals, simultaneously with said writing of the input waveform data in said waveform storage means, which plurality of read address signals are changed at a rate different from the rate of the write address signal, have an address difference of a designated magnitude therebetween, and which are used for simultaneously reading out waveform data from said waveform storage means; and a processing step of obtaining control data, which is changed over time, on the basis of address differences between the write address signal and the plurality of read address signals in correspondence with the plurality of read address signals, performing a weighting calculation according to the control data for a plurality of waveform data cyclically read out from said waveform storage means by the plurality of read address signals, adding the weighted waveform data to each other to obtain sum waveform data, and outputting the sum waveform data as output waveform data having a pitch obtained by changing a pitch of the input waveform data.

12. A digital pitch shifting method according to claim 11, wherein said step of generating said plurality of read address signals includes generating two read address signals to read out first and second waveform data, the two read address signals being generated to have a difference corresponding to an address value half a total number of addresses of said waveform storage means.

13. A digital pitch shifting method according to claim 12, wherein said processing step further includes:

executing a crossfade calculation by multiplying the first and second waveform data read out from said waveform storage means by the two read address signals with the control data, which are changed over time; and outputting the output waveform data having a changed pitch.

14. A digital pitch shifting method according to claim 11, wherein said step of generating said plurality read address signals further comprises:

generating a plurality of read address signals, each having an integer part and a decimal part;

reading out two waveform data by supplying an address corresponding to a value of the integer part of each read address signal, and an address corresponding to a value obtained by incrementing the former value by $+1$; and interpolating the two waveform data based on a decimal part of the read address signal for obtaining the output waveform data.

* * * * *